US006140573A

United States Patent [19]

Smith et al.

[11] Patent Number: 6,140,573

[45] Date of Patent: Oct. 31, 2000

[54] HOLLOW CORE COMPOSITE BUSHINGS

[75] Inventors: Norman Allen Smith; Wlliam Randalll Sellers, both of Alpharetta, Ga.

[73] Assignee: Siemens Aktiengesellschaft, Munich, Germany

[21] Appl. No.: 09/087,100

[22] Filed: May 29, 1998

[51] Int. Cl.[7] ..... H01B 17/42

[52] U.S. Cl. ..... 174/31 R; 174/18; 174/179

[58] Field of Search ..... 174/209, 176, 174/177, 178, 179, 189, 196, 18, 17 GF, 30, 31 R

[56] References Cited

U.S. PATENT DOCUMENTS

| | | | |
|---|---|---|---|
| 3,686,600 | 8/1972 | Conner et al. | 174/143 |
| 3,839,593 | 10/1974 | Meier et al. | 174/30 |
| 4,355,200 | 10/1982 | Wheeler et al. | 174/140 S |
| 4,426,547 | 1/1984 | Ogino | 174/31 |
| 5,466,891 | 11/1995 | Freeman et al. | 174/142 |
| 5,569,891 | 10/1996 | Freeman et al. | 200/17 |

*Primary Examiner*—Dean A. Reichard
*Assistant Examiner*—Adolfo Nino

[57] ABSTRACT

An improved hollow core composite bushing for use in, for example, a dead tank circuit breaker, is smaller and lighter and offers other advantages over previous designs. The hollow core bushing includes therein a fiber reinforced plastic (FRP) elongated tube that operates to increase the dielectric constant between a conductor and a transition shield. By placing the transition shield external to the hollow core bushing and providing the FRP tube between the conductor and transition shield, the dielectric constant between the shield and conductor is increased thus allowing the inner diameter of the shield and outer diameter of the bushing to be decreased. In addition, the transition shield may be an integral part of the flange that is mounted to the bushing current transformer support column or interrupter enclosure of the dead tank circuit breaker thus further reducing the diameter and overall size of the bushing. Further, the transition shield may be an integral part of the FRP tube.

10 Claims, 5 Drawing Sheets

HOLLOW CORE COMPOSITE BUSHINGS

BACKGROUND OF THE INVENTION

The present invention relates to an improved hollow core composite bushing and, more particularly, to an improved bushing for use within a dead tank circuit breaker.

Generally, dead tank circuit breakers are provided to direct the unimpeded flow of current in a network under normal operating conditions, and to interrupt the flow of excessive current in a failing network. Dead tank circuit breakers also may interrupt capacitor banks, isolate transformer switching, interrupt load current and/or perform a high speed open-close-open sequence to clear a fault. The successful achievement of these functions generally is dependent upon the circuit breaker's specific mechanical design to meet the demands of opening and closing the circuit breaker contacts, and dependent upon the specific electrical design to ensure that the circuit breaker can withstand the electrical stresses applied to it.

During the opening sequences an electric arc forms between the contacts of the circuit breaker. The discharge is utilized to assist in circuit-interruption. For example, in an AC network, the arc is tolerated in a controlled manner until the occurrence of a natural current zero of the sine wave. The arc then is rapidly quenched to limit the reaction of the network stability to the interruption. A typical circuit breaker may utilize the gas Sulfur Hexafluoride ($SF_6$) as the arc-quenching media. The gas $SF_6$ is preferred due its superior electrical insulation qualities and its ability to recover quickly (e.g., within 3 $\mu$sec) from high temperature arc interruption (e.g., above 2,000° K). Pure $SF_6$ gas is colorless, odorless, tasteless, nontoxic, chemically stable and non-flammable. $SF_6$ is in its gaseous state at 20° C. and atmospheric pressure, and has a density of approximately 4.7 times that of air. The critical temperature of $SF_6$ is 45.6° C., and may liquified under pressure.

A dead tank circuit breaker assembly consists of six isolation insulators for a 3-phase system. Three insulators are connected to a power source on one side of three interrupters and direct the 3-phase voltage through the circuit breaker. The 3-phase voltage is directed out by another set of 3 isolation insulators, which are on the load side of the circuit breaker interrupters.

Dead tank circuit breakers provide for separate internal transition shields that are secured to a grounded enclosure as a separate piece. Referring to the illustration shown in FIG. 1, a hollow core bushing 10 is placed over the transition shield 20 and secured to the grounded enclosure 22. This configuration requires the internal diameter of the hollow core bushing to be larger than the diameter of the transition shield, with sufficient clearance to prevent mechanical contact. The transition shield must also have an inside diameter sufficient to accommodate the dielectric constant (permittivity) between it (i.e., ground) and the conductor 24 (i.e., the electric potential). These factors contribute to larger parts. FIG. 2 illustrates a cut-out portion of the hollow core bushing shown in FIG. 1. As shown in FIG. 2, a space is formed between hollow core bushing 10 and transition shield 20 (also shown in FIG. 1). Conductor 24 is not shown in FIG. 2 for convenience.

Porcelain and composite bushings that are currently used within dead tank circuit breakers are problematic due to their large diameters and weight. Such bushings are fairly expensive and timely to manufacture and add to the overall weight and expense to dead tank circuit breakers. Moreover, porcelain bushings are susceptible to catastrophic failure when exposed to high impact which in turn may result in substantial damage to external and nearby equipment, as well as serious human injury.

It is therefore an object of this invention to provide an improved hollow core composite bushing that overcomes the above-mentioned disadvantages of existing bushings.

It is another object of this invention to provide an improved hollow core composite bushing with a reduced diameter as compared to previous designs.

It is a further object of this invention to provide a hollow core bushing with a lower center of gravity.

It is an additional object of this invention to provide a hollow core bushing having a reduced weight as compared to previous designs.

Various other objects, advantages and features of the present invention will become readily apparent to those of ordinary skill in the art, and the novel features will be particularly pointed out in the appended claims.

SUMMARY OF THE INVENTION

In accordance with an embodiment of the present invention, a hollow core bushing is comprised of an elongated hollow bushing body that has a plurality of sheds, and an elongated tube that extends within the interior of the bushing body and that is adapted to increase the dielectric constant between a conductor and a transition shield between which the elongated tube is placed.

As an aspect of the present invention, the elongated tube is an integral part of the elongated hollow bushing body.

As another aspect of the present invention, the elongated tube is comprised of fiber reinforced plastic.

As a further aspect of the present invention, the elongated tube is adapted to be placed within a tube-shaped transition shield such that the dielectric constant between the tube-shaped transition shield and the conductor is increased.

As an additional aspect of the present invention, the elongated tube has a diameter of substantially minimum dimension so as to externally receive a transition shield that has an inner diameter capable of accommodating the increased dielectric constant between the conductor and the transition shield.

In accordance with another embodiment of the present invention, a hollow core bushing in combination with an external transition shield includes an elongated hollow bushing body and an elongated tube that extends within the interior of the bushing body, and a transition shield that surrounds the external surface of the elongated tube. The elongated tube is adapted to increase the dielectric constant between the transition shield and a conductor that extends and is placed within the elongated tube.

As an aspect of this embodiment, the transition shield is in contact with the elongated tube.

As another aspect of this embodiment, the transition shield is an integral part of a flange that can be mounted to a bushing current transformer support column or interrupter enclosure.

As a further aspect of the present invention, a grading ring is coupled to the transition shield and is adapted to enhance an electric field at voltages of the conductor above a predetermined value.

In accordance with a further embodiment of the present invention, a hollow core bushing having a transition shield integral therewith includes an elongated hollow bushing body and an elongated tube that extends within the interior of the bushing body, and a transition shield that is an integral part of the elongated tube. The elongated tube is adapted to increase the dielectric constant between the transition shield and a conductor that extends and is placed within the elongated tube.

In accordance with a further embodiment of the present invention, a hollow core bushing in combination with an internal transition shield includes an elongated hollow bushing body and an elongated tube that extends within the interior of the bushing body, and a transition shield that is in contact with an internal surface of the elongated tube.

In accordance with yet another embodiment of the present invention, a method of providing a hollow core bushing with a reduced diameter for use with a transition shield and a conductor is provided by providing a hollow core bushing having an elongated tube extending therethrough, placing a tube-shaped transition shield around an external surface of the elongated tube, extending a conductor through and within the elongated tube of the hollow core bushing, increasing by the elongated tube a dielectric constant between the conductor and the transition shield, and establishing a diameter of the ground shield to accommodate the increased dielectric constant between the conductor and the transition shield.

As an aspect of this method, the transition shield is in contact with the elongated tube.

In accordance with yet a further embodiment of the present invention, a method of providing a hollow core bushing with a transition shield integrated therewith is provided by providing a hollow core bushing having an elongated tube extending therethrough, integrating a transition shield with the elongated tube, extending a conductor through and within the elongated tube, increasing by the elongated tube a dielectric constant between the conductor and the transition shield; and establishing a diameter of the elongated tube integral with the transition shield to accommodate the increased dielectric constant between the conductor and the transition shield.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF CERTAIN PREFERRED EMBODIMENTS

Figure 1:
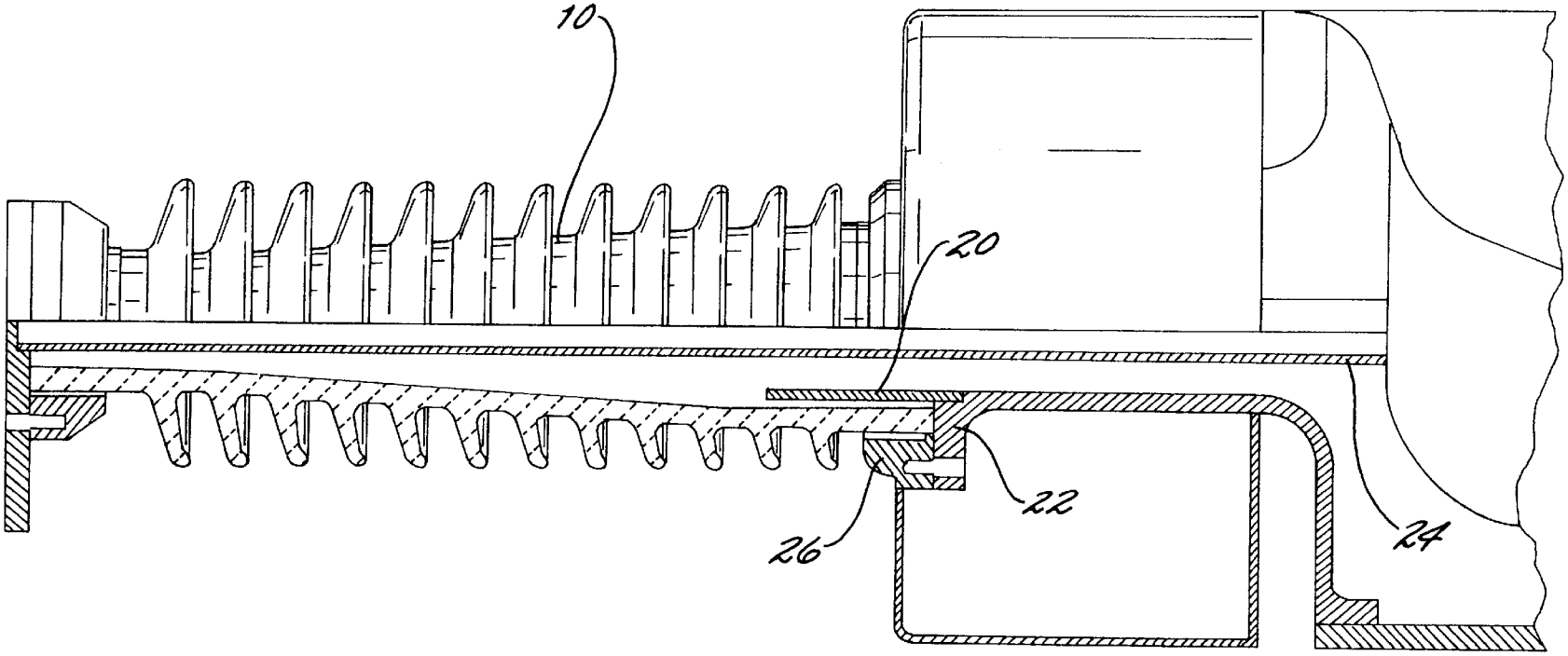
FIG. 1. (PRIOR ART)
FIG. 1 is a schematic illustration of a hollow core bushing with an internal shield.
Figure 2:
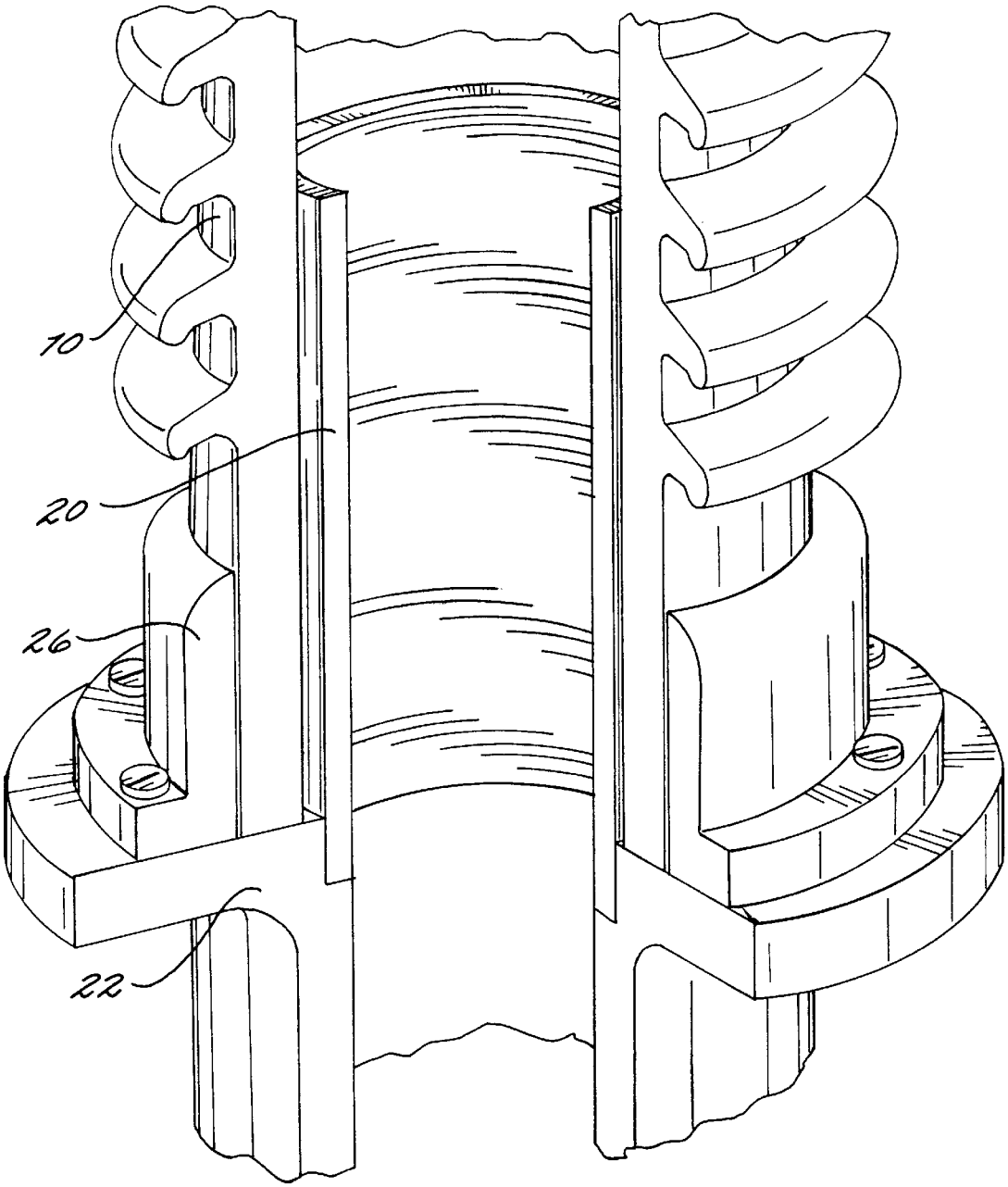
Fig. 2. (PRIOR ART)
FIG. 2 is a perspective illustration with a cut-out of the hollow core bushing shown in FIG. 1.
Figure 3:
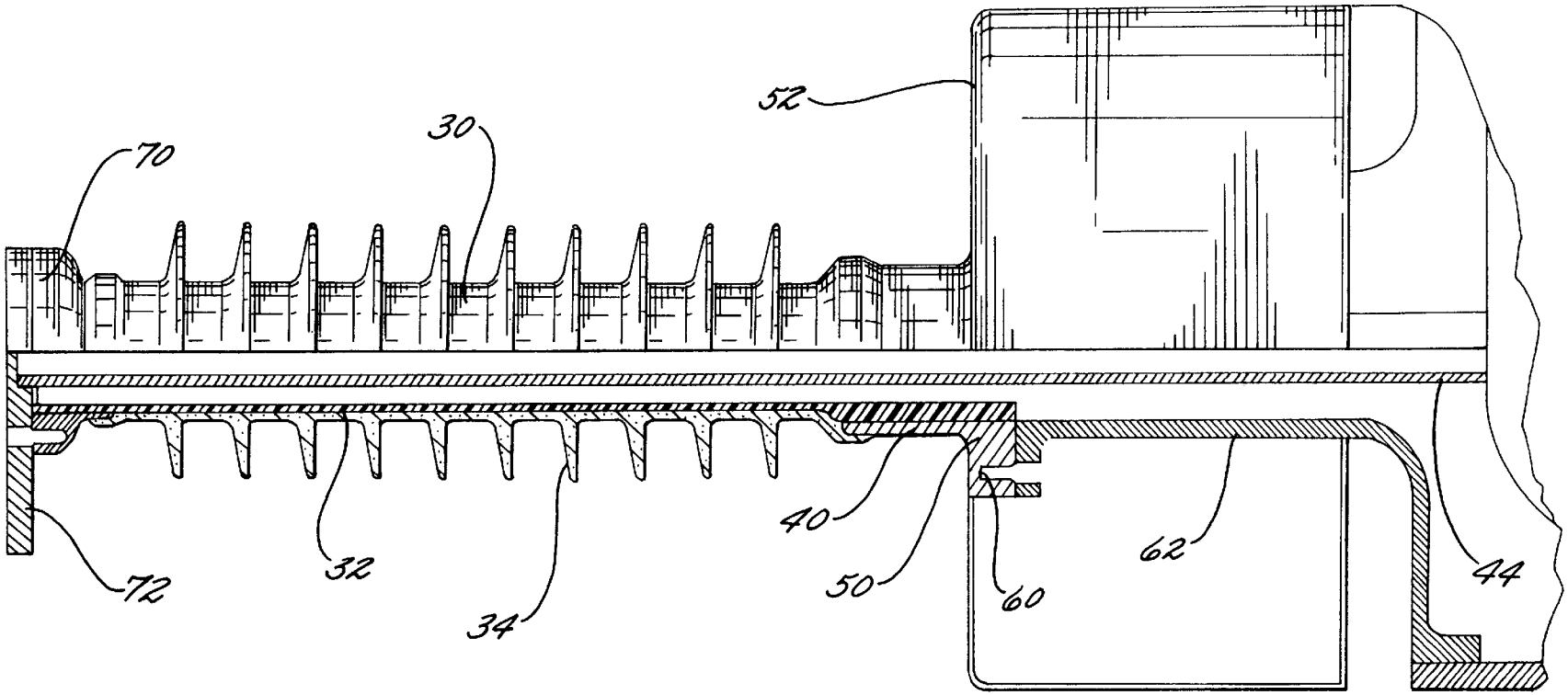
FIG. 3 is a schematic illustration of a hollow core bushing in accordance with the present invention.
Figure 4:
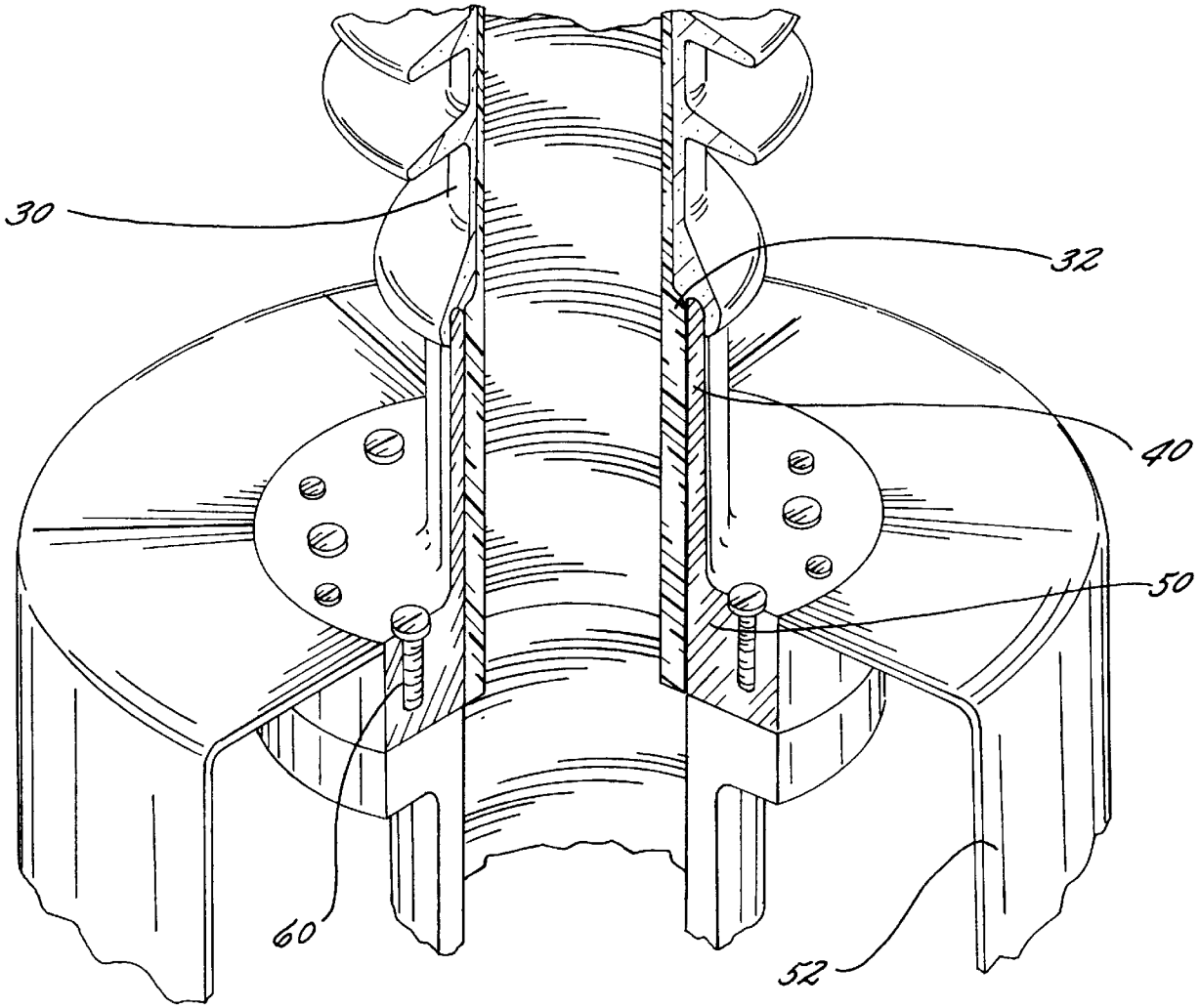
FIG. 4 is a perspective illustration with a cut-out of the hollow core bushing shown in FIG. 3 in accordance with the present invention.

Referring now to FIGS. 3 and 4 of the drawings, illustrations of a hollow core bushing 30 in accordance with the present invention are shown. Although not critical to the present invention, FIGS. 3 and 4, as well as FIGS. 1 and 2, illustrate 72.5 kV hollow core bushings. However, the present invention is not limited to this rating.

In accordance with the present invention, and as will be seen, the voltage grading or transition shield area is reduced in diameter to reduce the physical dimensions of the bushing, as well as the associated equipment. Referring back to the bushing shown in FIGS. 1 and 2, it is understood within the industry that it is not practicable to reduce the diameter of the bushing shown, as well as the diameter of other existing bushings, due to the physics of the electric field developed between the grounded transition shield 20 and the internal conductor 24 and the mechanical clearance required between the shield 20 and the internal conductor 24. As is known, a dielectric constant between the transition shield and the conductor must be maintained to prevent corona avalanche (electric flash over).

The present invention solves the aforementioned problem by utilizing within the hollow core bushing 30 a fiber reinforced plastic (FRP) tube 32 that is placed between a conductor 44 and the transition shield 40, as shown in FIGS. 3 and 4, which results in an increase in the dielectric constant between the shield 40 and the conductor 44. This, in turn, allows for the inner diameter of the transition shield 40 to be reduced resulting in an overall reduction in size of the transition shield 40.

In addition, by placing the transition shield 40 external to the FRP tube 32 (identified herein as the external design), no clearance is required between the FRP tube 32 of the bushing (or the bushing body 30) and the transition shield 40. Without any required clearance, the inner and outer diameters of the bushing are significantly reduced as compared to the bushing previously discussed. Thus, the preferred embodiment of the present invention involves providing the FRP tube 32 in contact with the transition shield 40. However, various advantages of the present invention are still realized by providing a small gap between the FRP tube 32 and the transition shield 40.

Also in accordance with the present invention, and as shown in FIGS. 3 and 4, the transition shield 40 is integrated with a bottom flange 50 that is mounted by appropriate hardware 60 to the flange of a bushing current transformer (BCT) support column 62 or interrupter enclosure. The hollow core bushing body 30 partially overlaps the integrated shield. This is in contrast to the bushing design shown in FIGS. 1 and 2 wherein the bottom flange 26 and the transition shield 20 are separate components and wherein the hollow core bushing 10 fully overlaps the transition shield 20. Similarly, and in accordance with the present invention, a shield may be integrated into the top flange 70 (FIG. 3) at the terminal pad 72 at the opposite end of the hollow core bushing wherein the hollow core bushing partially overlaps the integrated shield. The hollow core bushing 30 further includes silicone sheds 34 whereas bushing 10 shown in FIGS. 1 and 2 includes porcelain sheds. Of course, other moldable (or perhaps non-moldable) dielectric material other than silicone may be utilized by the present invention.

In accordance with another embodiment of the present invention, the FRP tube 32 and the transition shield 40 are integrated with one another. Such integration may be accomplished by providing the transition shield 40 between two sheets that comprise the FRP tube 32 or by another known way in which the FRP tube 32 and the transition shield 40 may be integrated. In this embodiment, the advantageous feature of increasing the dielectric constant between the shield 40 and the conductor 44 also is realized, as in the above-discussed embodiment, along with the advantageous feature of requiring one less individual component. Namely, the FRP tube 32 and the transition shield 40 may be manufactured as a single component. Still further, the integrated transition shield and FRP tube may also be integrated with a bottom flange that is mounted to the flange of a bushing current transformer support column or interrupter enclosure, yet again reducing the number of individual components.

In accordance with a further embodiment of the present invention, the transition shield is placed within (i.e., inside) and in contact with the FRP tube. While the dielectric constant is not increased, other advantages are gained including a small reduction in the width of the bushing as compared to previous designs.

As previously discussed, the bushing design of the present invention has a smaller diameter as compared to previous designs. The smaller diameter in turn results in a reduced volume, a reduced-sized bottom flange 50, a reduced-sized top flange 70, a reduced-sized enclosure mating flange and a reduced diameter of the slip over bushing current transformer. These reduced diameters result in a substantial reduction in weight of the bushing and associated components which in turn results in a decrease in the cost of the base materials. Reducing the weight of the components further advantageously permits a reduction in support structure materials and minimizes foundation designs. In addition, a desirable lowering of the center of gravity results as well.

In accordance with the present invention, total weight reduction to dead tank circuit breakers may range from 10% to 45% of porcelain or other composite designs. The total weight reduction depends on the weight of conventional porcelain or composite bushings, the weight of the bushing current transformers and the weight of the support structure. For $SF_6$ dead tank circuit breakers, the volume of $SF_6$ is decreased by 25% to 45% per bushing.

As can be appreciated from the above discussion, the purpose of the hollow core bushing of the present invention is to help minimize total weight and volume of High Voltage (HV) and Extra High Voltage (EHV) hollow core apparatus bushings for new manufacture and retrofits. By using a smaller overall diameter FRP tube, with an integrated transition shield at the base, the total weight and volume are substantially reduced as compared to other hollow core bushing designs.

The bushing of the present invention may be conveniently referred to as a "S.L.I.G.H.T." (or "SLIGHT") bushing, wherein the term "SLIGHT" identifies the various characteristics of the bushing. "SLIGHT" refers to a bushing with a "S" mall diameter tube, a "L"ower total cost, an "I"njection molded silicone sheds, a "G"ross weight minimized, a "H"igh hydrophobic capability, and a "T"ransition shield integration. The advantages of the SLIGHT bushing are summarized as follows: (1) smaller diameters of all associated components; (2) lighter weights for lighter support structures; (3) a lower center of gravity; (4) less assembly time; and (5) lower total costs. Also, FRP bushings do not fail catastrophically or damage surrounding equipment from failure.

Also as discussed above, the dielectric constants between electric potential to ground potential define the minimum clearance between components, and integration of the internal transition shield to the outside of the FRP tube or within the FRP tube improves the dielectric constant between energized parts and ground. The improved dielectric constant allows for a reduction in distance. The reduction in distance in turn provides for a reduction of the bushing diameter extending from the top flange to the bottom flange thereby resulting in: (1) a reduction of the total volume of the dielectric material (e.g., silicone) for the bushing sheds; (2) a reduction of the diameter of the FRP tubes for each voltage class; (3) a reduction of the volume of $SF_6$ gas (mixtures, etc.); (4) a reduction of the inside diameter of slip over BCT's for Dead Tank circuit breakers; (5) a smaller diameter top flange and terminal (flat or threaded) connection; (6) a lowered center of gravity for dead tank circuit breakers; (7) a reduced assembly time for (OEM) manufacturing; and (8) a reduction of total weight of the dead tank circuit breakers.

Figure 5:
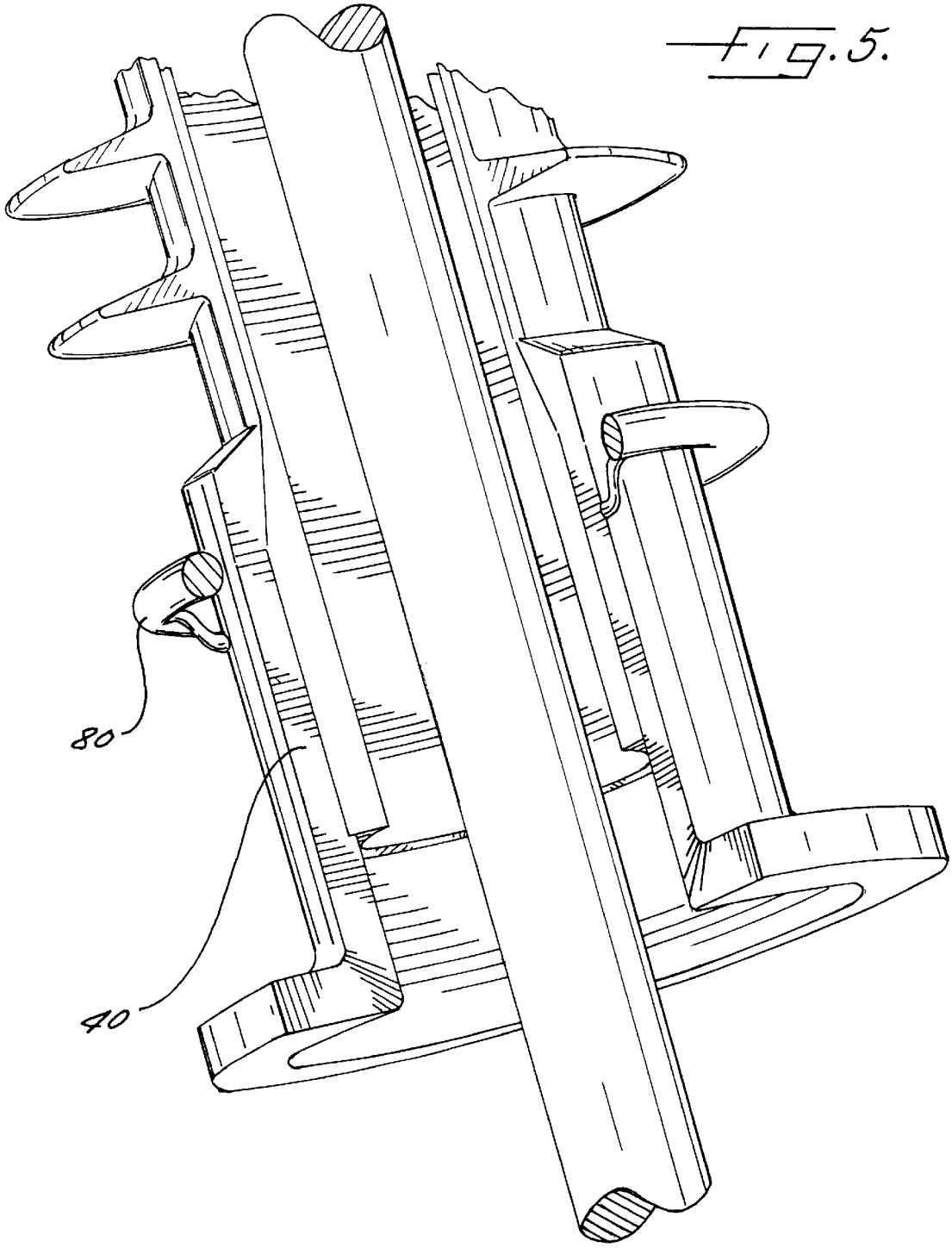
FIG. 5 is a perspective illustration of a hollow core bushing with a grading ring in accordance with another embodiment of the present invention.

Referring next to FIG. 5, an illustration of a hollow core bushing with a grading ring mounted to the external shield in accordance with the present invention is shown. Grading ring 80 is mounted to the external shield 40 to enhance the electric field at, for example, voltages at 72.5 kV and higher. The other features of the bushing and shield shown in FIG. 5 are identical to those discussed above with respect to FIGS. 3 and 4 and thus are not repeated herein.

While the present invention has been particularly shown and described in conjunction with a preferred embodiment thereof, it will be readily appreciated by those of ordinary skill in the art that various changes may be made without departing from the spirit and scope of the invention. For example, while the present invention has been described for use with dead tank circuit breakers, the present invention is not limited to dead tank circuit breakers and may be applied to transformers and gas insulated substations (GIS).

Therefore, it is intended that the appended claims be interpreted as including the embodiments described herein, the alternatives mentioned above, and all equivalents thereto.

What is claimed is:

1. A hollow core bushing comprising:

an elongated hollow bushing body;

a plurality of sheds connected to said elongated hollow bushing body and extending outwardly therefrom;

a conductor positioned within hollow portions of the bushing body for allowing current to flow therealong;

a transition shield having at least portions thereof positioned within the hollow bushing body between the conductor and inner surfaces of the bushing body for gradingly distributing voltage thereacross; and an elongated tube positioned in the bushing body between the conductor and the transition shield to thereby increase a dielectric constant between the transition shield and the conductor for preventing electric flash over.

2. A hollow core bushing as described in claim 1, wherein the transition shield further comprises a shield body with an opening extending through a medial portion thereof and a flange integrally formed as a single piece with the shield body, the flange having portions thereof extending outwardly from the bushing body and being positioned to be mounted to a bushing current transformer support column.

3. A hollow core bushing as described in claim 1, wherein portions of outer peripheral surfaces of said elongated tube extend beyond the location of the transition shield within the bushing body and abuttingly contact inner surfaces of said elongated hollow bushing body.

4. A hollow core bushing as described in claim 1, wherein said elongated tube comprises fiber reinforced plastic, and portions of outer peripheral surfaces of said elongated tube abuttingly contact inner peripheral surfaces of the transition shield within the opening of the shield body.

5. A hollow core bushing comprising:

an elongated hollow bushing body;

a conductor positioned within hollow portions of the bushing body for allowing current to flow therealong;

a transition shield having at least portions thereof positioned within the hollow bushing body between the conductor and inner surfaces of the bushing body for gradingly distributing voltage thereacross; and an elongated tube positioned in the bushing body between the conductor and the transition shield to thereby increase a dielectric constant between the transition shield and the conductor for preventing electric flash over.

6. A hollow core bushing as described in claim 5, wherein the transition shield further comprises a shield body with an opening extending through a medial portion thereof and a flange integrally formed as a single piece with the shield body, the flange extending outwardly from the bushing body and being positioned to be mounted to a bushing current transformer support column.

7. A hollow core bushing as described in claim 6, wherein portions of outer peripheral surfaces of said elongated tube extend beyond the location of the transition shield within the bushing body and abuttingly contact inner surfaces of said elongated hollow bushing body.

8. A hollow core bushing as described in claim 7, wherein said elongated tube comprises fiber reinforced plastic, and portions of the outer peripheral surfaces of said elongated tube abuttingly contact inner peripheral surfaces of the transition shield within the opening of the shield body.

9. A hollow core bushing as described in claim 8, further comprising a plurality of sheds connected to and extending outwardly transverse from said elongated hollow bushing body.

10. A hollow core bushing as described in claim 9, wherein each of the plurality of sheds comprises silicon.

* * * * *